United States Patent [19]

Miko

[11] 4,088,942

[45] May 9, 1978

[54] FERRORESONANT TRANSFORMER STRUCTURE

[75] Inventor: Sandor Miko, Indianapolis, Ind.

[73] Assignee: RCA Corporation, New York, N.Y.

[21] Appl. No.: 719,010

[22] Filed: Aug. 30, 1976

[51] Int. Cl.[2] ..... G05F 3/06; H01F 21/08

[52] U.S. Cl. ..... 323/60; 336/160; 336/165

[58] Field of Search ..... 336/155, 160, 165, 212; 323/60, 6

[56] References Cited

U.S. PATENT DOCUMENTS

| | | | |
|---|---|---|---|
| 2,432,343 | 12/1947 | Short | 323/60 |
| 2,436,925 | 3/1948 | Haug et al. | 323/60 |
| 2,488,742 | 11/1949 | Schwennesen | 336/165 |
| 3,059,143 | 10/1962 | Sola | 336/165 X |
| 3,546,571 | 12/1970 | Fletcher et al. | 336/165 X |

*Primary Examiner*—Thomas J. Kozma

*Attorney, Agent, or Firm*—Eugene M. Whitacre; Paul J. Rasmussen; Joseph Laks

[57] ABSTRACT

A ferroresonant transformer includes a transformer core, primary and secondary windings. A secondary core section of the transformer core is formed at least in part of a first magnetic material which saturates at a relatively small magnetizing force. The remainder of the transformer core is formed of a second magnetic material which saturates at a magnetizing force greater than that of the first magnetic material. The transformer also includes a ferroresonant capacitor which is responsive to the magnetic flux generated by current in the primary winding for generating a magnetic flux for saturating the secondary core.

5 Claims, 6 Drawing Figures

FERRORESONANT TRANSFORMER STRUCTURE

This invention relates to ferroresonant transformers.

Ferroresonant transformers are used in television receivers to supply operating voltages to the various receiver circuits and provide line isolation for reducing shock hazards. The regulating ability of a ferroresonant transformer is excellent even when the A.C. line fluctuations are severe. Good regulation is achieved by providing for operation of the secondary core at saturation while the primary core remains unsaturated. Because of the secondary core saturation, changes in line voltage will not result in any significant changes in output voltage.

Because the transformer must operate at a relatively low power line frequency, such as 60 Hz, a relatively large coil cross section and a large number of secondary turns are required in order to provide a given induced output voltage. This requirement results in a relatively heavy and bulky transformer structure. For a given power supply output voltage and current, it is desirable to design a transformer core which minimizes lamination weight and copper usage and which as the same time maximizes the use of cheaper, lower grade magnetic materials.

It is known, as disclosed in U.S. Pat. No. 2,488,742 granted to D. O. Schwennensen, to construct a transformer with a composite core made of two different materials, the secondary core of which is formed of a material having a flux density at saturation which is less that that of the material in the primary core. Such a transformer core, however, is undesirable in a ferroresonant transformer where large flux densities at saturation are desirable.

SUMMARY OF THE INVENTION

A ferroresonant transformer includes primary and secondary windings, a capacitor and a transformer core. The transformer core includes a primary core section for linking magnetic flux to the primary winding and includes a secondary core section for linking magnetic flux to the secondary winding. A magnetic shunt path returns portions of the magnetic fluxes generated by each of the windings without linking those portions to the other winding. The secondary core section is formed at least in part from a first magnetic material which saturates at a relatively small magnetizing force. The remainder of the transformer core is formed at least in part from a second magnetic material which saturates at a magnetizing force greater than that of the first magnetic material. The capacitor is responsive to the magnetic flux generated by the current in the primary winding for generating a magnetic flux for saturating the secondary core section under the secondary winding.

DESCRIPTION OF THE INVENTION

Figure 1:
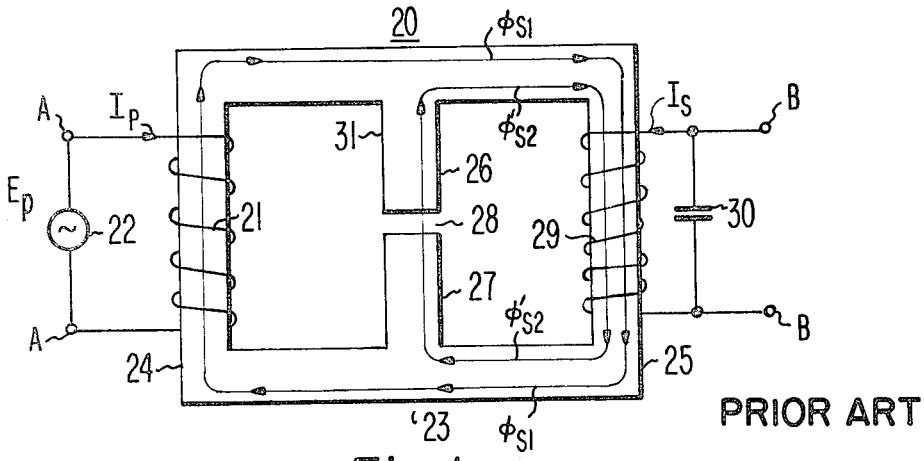
FIG. 1 illustrates a prior art ferroresonant transformer.

FIG. 1 illustrates a conventional ferroresonant transformer 20 having a primary winding 21 coupled to a source 22 of fluctuating voltage $E_p$ at terminals A—A. A transformer core 23 comprises a C-shaped primary core 24, a C-shaped secondary core 25 and a magnetic shunt path 31 (common to both the primary and secondary cores) comprising legs 26 and 27 and an air gap 28. Across a secondary winding 29 is coupled a ferroresonant capacitor 30. Output voltage $E_s$ is obtained across terminals B—B.

Fluctuating primary current generates a fluctuating primary magnetic flux $\phi_p$ in primary core 24. Because of the shunt path 31, not all the generated primary flux is magnetically linked to the secondary winding. The amount of flux linked to the secondary winding will depend, among other factors, upon the ratio of the reluctances of the shunt path 31 and secondary core 25. Thus, flux $\phi_p$ divides into two portions, $\phi_{SH1}$ flowing through magnetic shunt path 31 and $\phi_{S1}$ flowing through secondary core 25.

The fluctuating flux $\phi_{S1}$ linking secondary winding 29 generates an induced EMF, $E_s$, across the winding 29 and across capacitor 30. The induced EMF, $E_s$, generates a secondary load current $I_s$ through winding 29 and capacitor 30. Assuming no resistive loads connected to terminals B—B, negligible core losses and negligible resistive loss for the winding and capacitor, the impedance coupled to $E_s$ is purely capacitive, and the secondary load current $I_s$ will lead the voltage $E_s$ by 90°. The secondary load current $I_s$ generates an additional flux $\phi_{S2}$ in the secondary core which is substantially in-phase with the secondary flux $\phi_{S1}$. All of this additional flux does not link the primary winding, since much of the flux returns to the secondary core through shunt path 31. That portion of the additional secondary flux $\phi_{S2}$ that does link primary winding 22 generates a counter EMF in the primary winding which in turn produces a additional primary load current. This additional primary load current produces an opposite phase counter flux in the primary core which partly cancels the additional secondary flux $\phi_{S2}$ in the secondary core and substantially cancels $\phi_{SH1}$ in the shunt path 31. For simplicity only the resultant fluxes are shown in FIG. 1. A total primary current $I_p$ generates a resultant flux equal to the secondary flux $\phi_{S1}$. The secondary current $I_s$ generates a resultant secondary flux $\phi_{S2}'$.

The basic principle of ferroresonant transformer operation is to operate the secondary core at saturation flux densities under predetermined load conditions, while at the same time, in order to limit input line current, operate the primary core unsaturated. Such operation is achieved by use of ferroresonant capacitor 30 and magnetic shunt path 31. Proper choice of core cross-section and air gap length for magnetic shunt path 31 provides return paths for the fluxes generated by each of the windings which do not link the other winding. Proper choice of capacitor value with respect to the magnetic properties of the core material will result in a secondary current $I_s$ which produces an in-phase flux saturating the secondary core.

Figure 2:
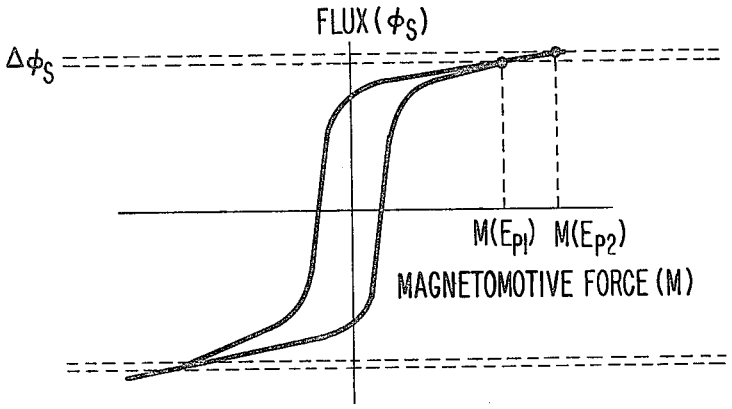
FIG. 2 is a magnetization curve associated with the ferroresonant transformer of FIG. 1.

As shown by the magnetization curve of FIG. 2, a ferroresonant transformer provides good line regulation. The total flux $\phi_S$ linking the secondary winding and equal to $\phi_{S1}$ and $\phi_{S2}'$ is plotted as function of the magnetomotive force M generated in the secondary winding by the input voltage $E_p$. If the secondary core is maintained at saturation, changes of input voltage from $E_{p1}$ to $E_{p2}$ will result in only a small change $\Delta\phi_S$ in the secondary core flux and thus only a small change in output voltage $E_s$.

Figure 3:
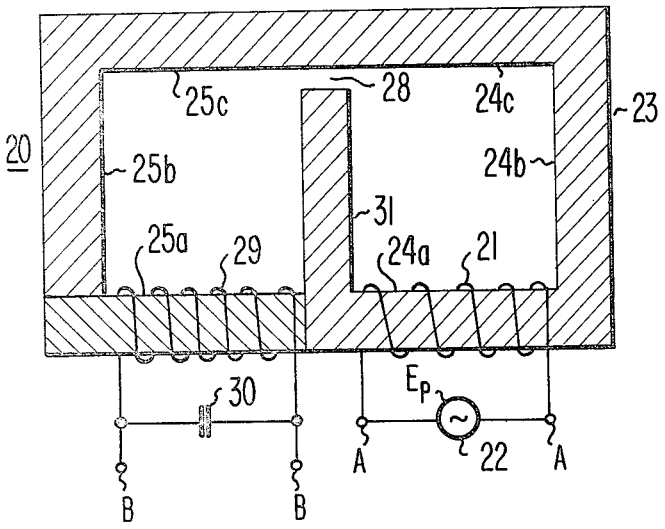
FIG. 3 illustrates a ferroresonant transformer embodying the invention.

The ferroresonant transformer of FIG. 3, which embodies the invention, is illustrated as having the same general shape as the transformer of FIG. 1. Similar elements are identically designated. Secondary winding 29 is located on the outer leg 25*a* of the C-shaped secondary core comprising legs 25*a*, 25*b* and 25*c* instead of on the center leg 25*b*. Similarly located is the primary winding 21 on the primary core comprising legs 24*a*, 24*b* and 24*c*. Shunt path 31 has its air gap 28 located at one end of the path instead of being centrally located as in the arrangement of FIG. 1. Such differences in the location of the windings and air gap are of design choice and have little significant effect on the basic principle of operation of the transformer.

Figure 4:
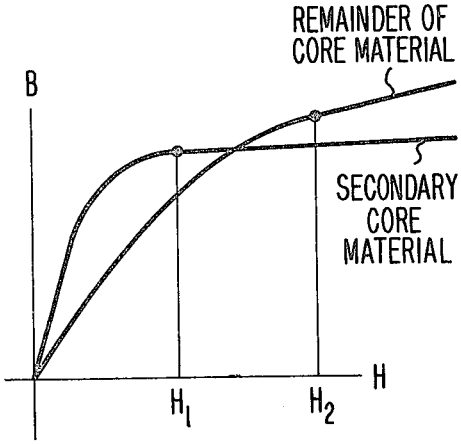
FIG. 4 illustrates magnetization curves associated with the ferroresonant transformer of FIG. 3.

According to a main feature of the invention, the secondary core is formed, at least in part, from a magnetic material different than the remainder of the transformer core. As shown in FIGS. 3 and 4, secondary core leg 25*a* is formed from a high quality magnetic material which has a high average permeability and which saturates at a relatively small magnetizing force $H_1$. The remainder of the core is formed from a lower grade material having a lower average permeability and which saturates at a magnetizing force $H_2$, larger than $H_1$. The magnetomotive force that must be generated by the current flowing through ferroresonant capacitor of FIG. 3 is now much smaller than that required by the single-material transformer core of FIG. 1. Only a small saturating current need flow through the capacitor, and therefore a smaller capacitance may be used for a given output voltage $E_s$. Since saturation of the secondary core is predominantly influenced by the current flowing through ferroresonant capacitor 30, only the secondary core under the secondary winding need be formed of the higher quality material. The only significant requirement influencing the shape and material of the remainder of the transformer core is maintaining the primary core unsaturated at given load and line conditions. It should also be noted that capacitor 30 need not be coupled across winding 29 but may have a separate winding if desired.

Use of the two-material type core in a ferroresonant transformer will result in the following savings and improvements over a single-material type core:

(1) A higher quality material in the secondary core will provide better output voltage regulation because of the less sharply sloping magnetization curve at saturation, as shown in FIG. 4.

(2) The higher quality secondary core material will produce lower core losses.

(3) The lower cost for the bulk of the transformer core material will more than offset the higher cost for the secondary core material.

(4) A lower saturating secondary current through capacitor 30 will result in lower copper losses in the windings; less copper wire and of smaller gauge may be used. The reduction in copper wire will appreciably reduce the total amount of magnetic material required in the core structure.

(5) A smaller capacitance may be used because of the lower secondary current requirement.

Figure 5:
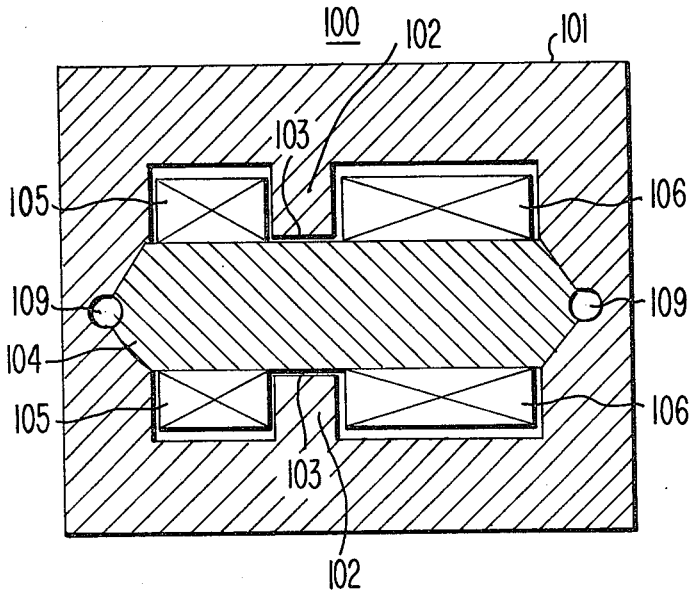
FIG. 5 illustrates another ferroresonant transformer embodying the invention.
Figure 6:
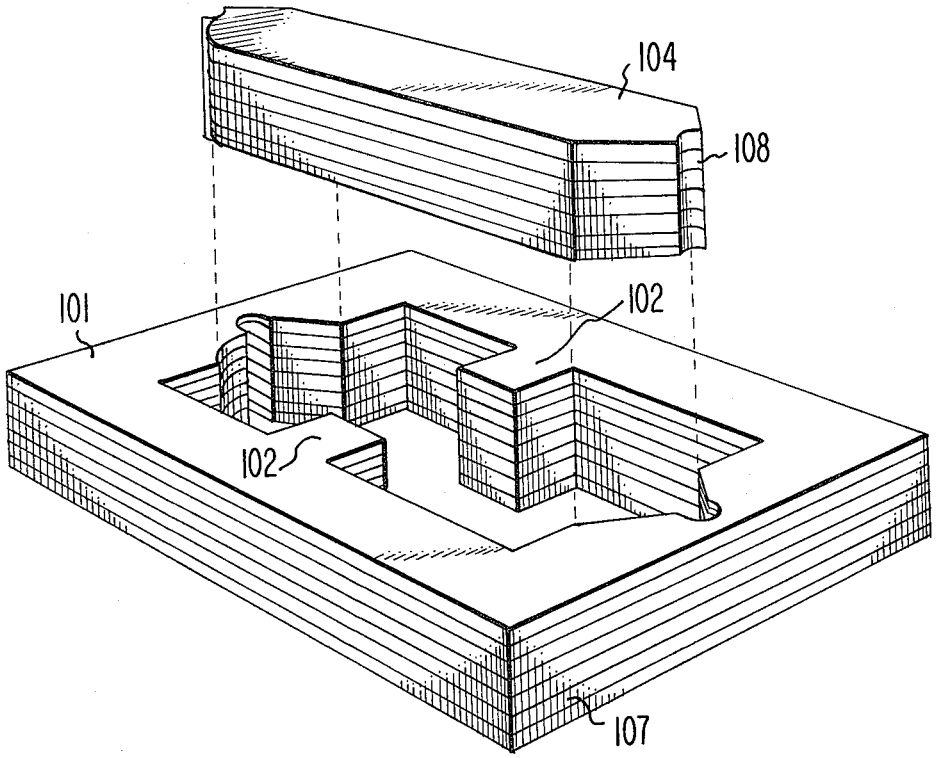
FIG. 6 is an exploded perspective view of the ferroresonant transformer core of FIG. 5.

FIGS. 5 and 6 illustrate a ferroresonant transformer 100 embodying the invention and which is suitable for manufacturing use. The two-piece transformer core is of generally cruciform shape, including a generally rectangular laminated outer frame 101 and a laminated center core piece 104 tightly fit within the outer frame 101. A magnetic shunt path comprising legs 102 and air gaps 103 apportions the magnetic flux between the outer frame 101 and center core piece 104. Also illustrated are optional mounting holes 109. A primary winding 105 is wound around on a portion of center core 104, and a secondary winding 106 is wound around another portion of the center core. A ferroresonant capacitor, not shown, would be coupled across the secondary winding during operation of the transformer.

The center core piece 104 is formed of a higher grade magnetic material, such as grain oriented silicon steel, while the outer frame is formed of a lower quality material such as low carbon nonoriented steel. The use of high grade magnetic material in center core piece 24 permits saturation of the core under the secondary winding 106 at small secondary currents as compared to a single-material transformer core of similar design with all the ensuing advantages aforementioned resulting. As mentioned previously, the primary core and shunt material and geometry need only be such as to maintain the primary core unsaturated. Even though the primary winding 105 is also located on the higher quality magnetic material of center core piece 104, the primary core under winding 105 is still maintained below saturation by means of the shunting arrangement of elements 102 and 103. By locating the primary and secondary windings on the same center core piece 104, manufacturing and assembly techniques are simplified. The exploded perspective view in FIG. 6 of the transformer core of FIG. 5 clearly shows the stacking of laminations 107 and 108 of outer frame 101 and center core piece 104, respectively, to provide the appropriate core stack height.

A ferroresonant transformer according to the invention and having the cruciform structure of FIGS. 5 and 6 was constructed and operated. The two-material type core has a center core piece formed of grain oriented silicon steel M6X-29 gauge, and an outer frame 101 formed of low carbon nonoriented steel-24 gauge, such as may be obtained from the Temple Steel Company, Chicago, Illinois, under the trade name of Temp Core. Other dimensions are as follows: Outside dimensions of frame 101 are 4.5 by 3.625 inches; inside dimensions of frame 101 are 3.07 by 2.195 inches; width of shunt leg 102 is 0.500 inch; thickness of air gap 0.050 inch. Width of window gap in outer frame 101 in which the secondary winding 106 is located is 1.615 inch; width of window gap in outer frame 101 in which the primary winding 105 is located is 0.955 inch. Maximum length of center core piece 104 is 3.784inches; width of center core piece 104 is 1 inch. Lamination stack height is 1.55 inch.

At an input voltage $E_p$ of 120 volts RMS, a full wave rectified center tap grounded D.C. voltage of 175 volts can be obtained with 263 primary winding turns and 688 secondary winding turns.

The accompanying table lists the physical and electrical characteristics of a two-material core ferroresonant transformer embodying the invention. The size and shape and material are similar to the transformer of FIG. 5. For comparison, the characteristics of a conventional single-material ferroresonant transformer of similar design are also included. The conventional ferroresonant transformer was formed of M22–26 gauge, Silicon Steel. Both transformers were designed to provide almost identical output power at full load.

TABLE

| Characteristic | Two-Material Core | Conventional Core |
|---|---|---|
| Total weight in pounds | 6.75 | 9 |
| Lamination weight in pounds | 5.1 | 7 |
| Copper weight in pounds | 1 | 1.26 |
| Stack height in inches | 1.7 | 2 |
| Input power in watts | 170 | 164 |
| Output power in watts | 134 | 131 |
| Power efficiency in percent | 79 | 80 |
| Output voltage change in percent when input volt changes ±12.5% | ±0.1 | ±1.1 |
| Output voltage change in percent when output load current changes ±40% | ±1.4 | ±1.9 |
| Short circuit power in watts | 27 | 55 |
| Short circuit current in RMS ampere | 2.8 | 3 |
| Capacitor in uF if secondary/primary turns ratio of conventional transformer is used | 1.9 | 3.5 |
| Capacitor current in RMS amperes | 0.53 | 1.05 |
| Input current in RMS amperes | 0.5 | 0.5 |

Upon examining the information in the above table, one readily notes that the ferroresonant transformer according to the invention is lighter, less bulky and uses less copper than a similar conventional ferroresonant transformer. Its electrical characteristics are superior and a significant reduction in costs is obtained.

What is claimed is:

1. A ferroresonant transformer, comprising:

a primary winding and at least one secondary winding;

a transformer core including a primary core section upon which said primary winding is located for providing a magnetic path linking magnetic flux to said primary winding and including a secondary core section upon which a first secondary winding is located for providing a magnetic path linking magnetic flux to said first secondary winding;

a magnetic shunt path for returning portions of said magnetic fluxes generated by each of said primary and said first secondary windings without linking said portions to the other of said primary and said first secondary windings; and a capacitor coupled to a winding other than said primary winding, the value of said capacitor selected for forming a ferroresonant transformer for generating an increased magnetic flux for saturating said secondary core section under said first secondary winding, at least a portion of said primary core section formed from a first magnetic material selected for a magnetic property wherein the saturation flux density is equal to that of low carbon non-oriented steel, said secondary core formed at least in part from a second magnetic material selected for a magentic property wherein the saturation flux density is equal to that of grain oriented silicon steel, said portion of said secondary core section further selected for a magnetic property wherein the magnetizing force at which saturation flux density occurs for said portion of said secondary core section is less than the magnetizing force at which saturation flux density occurs for said portion of said primary core section for reducing the magnetizing current requirement of said capacitor.

2. A ferroresonant transformer according to claim 1 wherein said transformer core comprises a generally rectangular outer frame with an interior leg located inwardly of said frame joining opposite portions of said outer frame.

3. A ferroresonant transformer according to claim 2 wherein said interior leg is formed entirely of said first magnetic material.

4. A ferroresonant transformer according to claim 3 wherein both said primary and said first secondary windings are located on said interior leg.

5. A ferroresonant transformer according to claim 4 wherein said capacitor is coupled to said secondary winding.

* * * * *